US010016869B2

(12) United States Patent
Giurlani

(10) Patent No.: US 10,016,869 B2
(45) Date of Patent: Jul. 10, 2018

(54) DEVICE FOR SHARPENING BLADES

(71) Applicant: FUTURA S.P.A., Capannori (LU) Fraz. Guamo (IT)

(72) Inventor: Giovacchino Giurlani, Capannori (IT)

(73) Assignee: FUTURA S.P.A., Capannori (LU) Fraz. Guamo (IT)

( * ) Notice: Subject to any disclaimer, the term of this patent is extended or adjusted under 35 U.S.C. 154(b) by 116 days.

(21) Appl. No.: 15/038,854

(22) PCT Filed: Oct. 17, 2014

(86) PCT No.: PCT/IT2014/000274

§ 371 (c)(1),
(2) Date: May 24, 2016

(87) PCT Pub. No.: WO2015/079464

PCT Pub. Date: Jun. 4, 2015

(65) Prior Publication Data

US 2017/0014966 A1 Jan. 19, 2017

(30) Foreign Application Priority Data

Nov. 30, 2013 (IT) ..... FI2013A0291

(51) Int. Cl.
*B24B 3/36* (2006.01)
*B24B 49/10* (2006.01)
(Continued)

(52) U.S. Cl.
CPC ..... *B24B 3/36* (2013.01); *B24B 3/46* (2013.01); *B24B 49/02* (2013.01); *B24B 49/10* (2013.01)

(58) Field of Classification Search
CPC .... B24B 3/36; B24B 3/46; B24B 3/54; B24B 19/002; B24B 49/003; B24B 49/006; B24B 49/02; B24B 49/04; B24B 49/045; B24B 49/10; B24B 49/12; B24D 15/06; B24D 15/082
See application file for complete search history.

(56) References Cited

U.S. PATENT DOCUMENTS 5,906,534 A * 5/1999 Folkman ..... B24B 3/54 451/45
2005/0064795 A1 3/2005 Giurgiuman et al.
(Continued)

FOREIGN PATENT DOCUMENTS

EP 2145742 A1 1/2010
EP 2097231 B1 6/2010
(Continued)

*Primary Examiner* — Timothy V Eley
(74) *Attorney, Agent, or Firm* — McGlew and Tuttle, P.C.

(57) ABSTRACT

Device for sharpening blades of cutting-off machines, comprising two grinding wheels (1) each positioned on a corresponding side of a cutting edge (20) of a blade (2) of a cutting machine. The device comprises means adapted for controlling the symmetry of said cutting edge (20), with a sensor (3) placed at a predetermined distance from a corresponding side of the cutting edge (20. The sensor (3) is adapted to detect possible differences (d) between the lengths (n, p) of the two sides of the cutting edge (20). The sensor (3) is connected to a programmable unit (4) that processes the said difference (d) possibly detected by the sensor (3).

8 Claims, 5 Drawing Sheets

(51) Int. Cl.
*B24B 49/02* (2006.01)
*B24B 3/46* (2006.01)

(56) References Cited

U.S. PATENT DOCUMENTS

2011/0281503 A1* 11/2011 Knecht ..... B24B 3/54
451/5
2012/0156964 A1* 6/2012 Anderson ..... B24B 51/00
451/5
2012/0184186 A1* 7/2012 Graham, Jr. ..... B23D 63/123
451/45
2016/0082563 A1* 3/2016 Arndt ..... B24B 3/36
451/45

FOREIGN PATENT DOCUMENTS

GB 1301988 A 1/1973
WO 2007/097724 A2 8/2007

* cited by examiner

DEVICE FOR SHARPENING BLADES

The present invention relates to a device for sharpening blades that can be used, in particular, for the production of paper rolls.

It is known that paper rolls, such as rolls of toilette paper and rolls of kitchen paper, are made by subdividing a paper log to obtain a plurality of shorter rolls by means of so-called "cutting-off machines".

The transverse cut of the logs is particularly critical. In fact, the cutting of the logs along planes that are not perfectly orthogonal to the axis of the same involves the formation of defective rolls, in which the side bases are oblique. This drawback is even more serious when the rolls are intended to be used in automatic dispensers which require, in fact, rolls with the side bases perfectly orthogonal to the axis of the rolls themselves, otherwise the rolls tend to get jammed in the dispenser.

The main object of the present invention is to provide a device that allows the elimination, or at least a great reduction, of the above-mentioned drawbacks.

This result is achieved, according to the present invention, by adopting the idea of realizing a device having the features indicated in claim 1 Other features of the invention are the subject of the dependent claims.

Thanks to the present invention, it is possible to always ensure a correct orthogonality of the bases of the rolls relative to the axis of the logs from which they are obtained, allowing a drastic reduction of scraps and the production of paper rolls especially, though not exclusively, usable in automatic dispensers. Furthermore, a device in accordance with the present invention is relatively simple and can be easily configured according to the specific production requirements.

These and other advantages and features of the present invention will be best understood by anyone skilled in the art from the following description and with the help of the accompanying figures, given as a practical exemplification of the invention, but not to be considered in a limitative sense, in which.

Figures 1, 2:
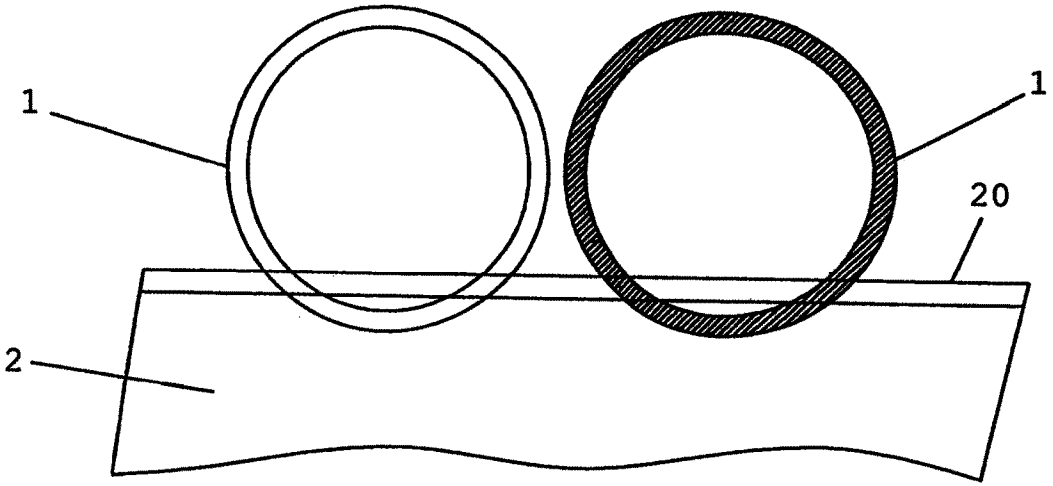
FIG. 1 is a schematic side view of a portion of the blade of a cutting machine on whose bevel two grinding wheels act from opposite sides.
FIG. 2 is a schematic front view of the whole of FIG. 1, in which the blade bevel is perfectly symmetrical.
Figure 4:
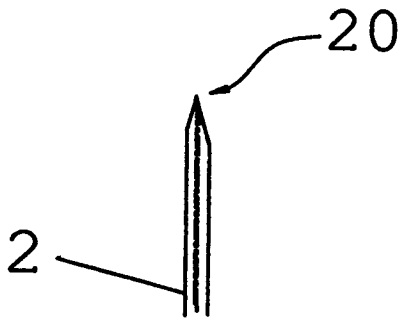
Figure 3:
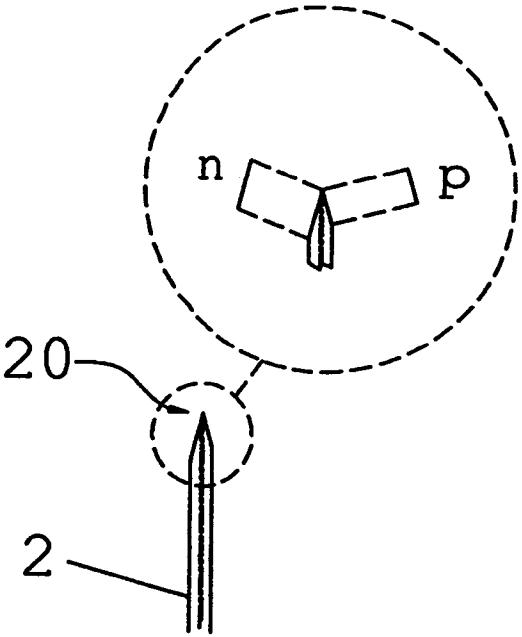
Figure 6A:
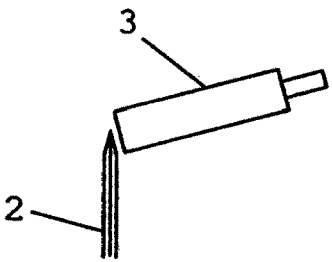
Figure 5:
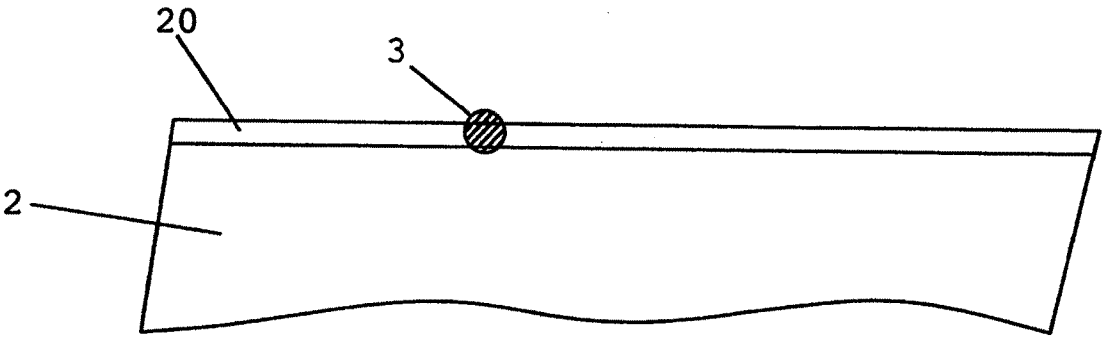
Figure 6C:
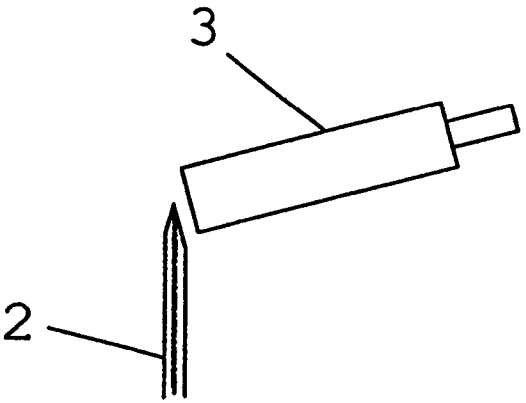
Figure 6B:
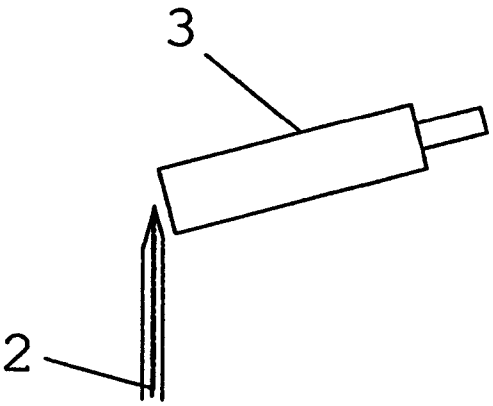
Figure 7:
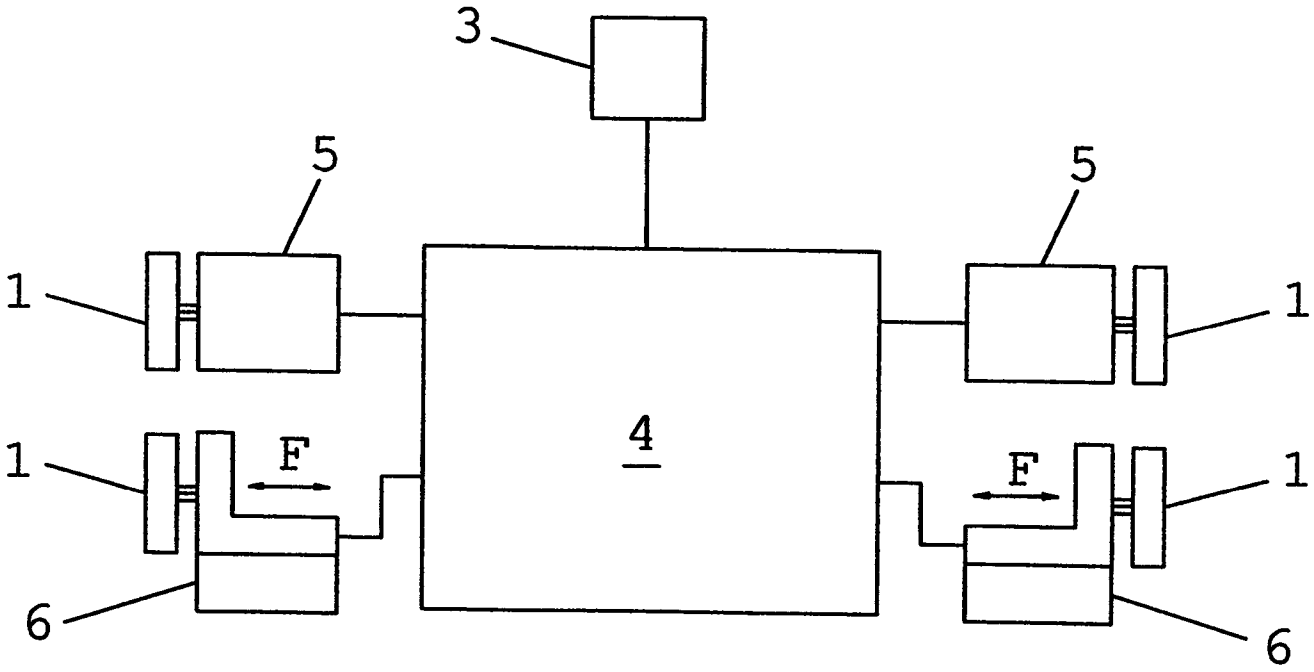

FIG. 3 and FIG. 4 schematically show two blades with an asymmetric bevel;

FIG. 5 is a schematic side view of another portion of the blade of FIG. 1 in which is shown a sensor of a control device in accordance with the present invention;

FIGS. 6A, 6B and 6C represent a schematic front view of the whole of FIG. 4, in which the bevel of the blade is symmetrical (FIG. 6*a*) or asymmetric (FIGS. 6BE 6C);

FIG. 7 is a simplified block diagram of a control device in accordance with the present invention.

Reduced to its basic structure, a device in accordance with the present invention is a device for sharpening blades used in the so-called cutting-off machines. The device includes a grinding wheel (1) acting on each of the two sides of a blade (2) of a cutting-off machine. The structure and operation of the grinding wheels (1), the blade (2) and of the cutting-off machine (T) are known per se to those skilled in the art and, therefore, are not described in greater detail. Examples of cutting machines for the production of paper rolls are provided, for example, in EP2097231 and EP2145742. A device for sharpening the blade of a cutting-off machine is disclosed in GB1301988. According to the example shown in the FIGS. 5-6C, a control device in accordance with the present invention comprises a capacitive or inductive sensor (3) positioned on one side of the blade (2) at a predetermined distance from the same, and more precisely in a predetermined lateral position with respect to the cutting edge (20) of the blade itself. In the example, the blade (2) is a band blade.

The sensor (3) can be positioned, for example, downstream of the grinding wheels (1) with respect to the advancement direction of the blade (2). In general, there are three cases.

With reference to the diagrams of FIGS. 2, 3 and 4 and respectively FIGS. 6A, 6B and 6C the three cases are the following:

(a) $n>p$ (b) $n\approx T$ (c) $n<p$ wherein n and p are the length of the left side and the length of the right side of the edge (20). These lengths (n, p) are detected in a plane transverse to the blade (2).

Cases (a) and (c) are related to a condition of asymmetry of the cutting edge (20) and then of possible execution of improper cutting of the logs by the blade (2).

Case (b) is related to a condition of symmetry of the cutting edge (20) and then of correct execution of the cut of the logs by the blade (2).

The sensor (3) detects the length (n, p) of the left and right sides of the cutting edge (20). Therefore, it can be detected an error, equal to the difference ($d=n-p$) of these lengths.

A programmable electronic unit (4) receives signals from the sensor (3). The unit (4) acts on the wheels (2)—as further described in the following—in function of the value assumed by the difference "d".

More particularly, the unit (4) acts on the grinding wheels (1) if the absolute value of "d" is greater than a predetermined reference amount. For example, the unit (4) acts on wheels (1) if the absolute value of "d" is greater than 1 mm.

The unit (4) does not intervene if the absolute value of "d" is less than the predetermined reference amount. For example, the unit (4) does not act on grinding wheels (1) if the absolute value of "d" is less than 1 mm.

For example, if the grinding wheels (1) are motorized grinding wheels, that is, each grinding wheels is driven by a rotary actuator (5), the unit (4) acts on the actuators (5) by adjusting the rotation speed of the grinding wheels (1) as long as the absolute value of "d" is greater than the predetermined reference amount.

Or, for example, if the grinding wheels (1) are each connected to a respective motorized slide (6), the unit (4) acts on the motorized slides (6) by adjusting the pressure exerted by the grinding wheels (1) on the cutting edge (20) as long as the absolute value of "d" is greater than the preset reference quantity as schematically indicated by the arrows "F" in FIG. 7.

The actuators (5) and the slides (6) are represented in the diagram of FIG. 7, in which, for simplification, to the unit (4) are connected both the actuators (5) and the slides (6), although, in general, it is preferred to connect both grinding wheels to rotary actuators only or to motorized slides only.

The unit (4) acts on the right grinding wheel (1) or on the left grinding wheel (1) depending on the sign, positive or negative, of the difference $d=n-p$.

Thanks to this device it is possible, therefore, control the condition of symmetry of the cutting edge (20) of a blade (2) and automatically intervene to restore the symmetry when the cutting edge (20) will wear asymmetrically.

The unit (4) can emit a light signal and/or an acoustic alarm when the absolute value of "d" is greater than the predetermined reference amount.

The unit (4) can also be programmed to emit the said audible alarm and/or light signal in the case of detection of the condition of asymmetry of the cutting edge (20) without operating any automatic intervention on the grinding wheels (1). In this case, an operator will sharpen the blade (2) by acting manually on the grinding wheels (1) when the unit (4) will emit the acoustic and/or light signal.

In accordance to what has been disclosed above, the unit (4) intervenes when the difference (d=n−p) exceeds, in absolute value, a predetermined limit, the intervention being selectively operated on the grinding wheel that is on the right of the blade or on the left of the blade in function of the sign, positive or negative, of this difference.

The sensor (3) can be, for example, of the inductive or capacitive type.

In practice, the details of execution may vary in any equivalent way as in the shape, dimensions, elements disposition, nature of the materials used, without leaving the scope of the adopted solution and thus remaining within the limits of the protection granted by this patent.

The invention claimed is:

1. A device for sharpening blades of cutting-off machines, the device comprising:

two grinding wheels, each of the two grinding wheels being positioned, during sharpening, on a corresponding side of two sides of a cutting edge of a blade of a cutting-off machine; and a means for controlling a symmetry of said cutting edge, said means comprising a programmable unit and a sensor placed, during sharpening, at a predetermined distance from a corresponding side of the cutting edge, said sensor being adapted to detect possible differences between radial direction lengths of the two sides of the cutting edge, said lengths being detected in a plane transverse to said blade, said sensor being connected to the programmable unit, wherein:

the programmable unit processes a possible difference in radial direction lengths of the two sides of the cutting edge detected by the sensor;

said possible difference has a value with a sign, positive or negative, corresponding to one side, positive, or the other side, negative, of the two sides of the cutting edge being longer; and the programmable unit is programmed to selectively operate one of the two grinding wheels as a function of the sign, positive or negative, of said possible difference.

2. A device according to claim 1, wherein said programmable unit emits one or more of an acoustic signal and a luminous signal when said difference exceeds, in absolute value, a predetermined limit.

3. A device according to claim 1, wherein said grinding wheels are dragged by respective motors, said programmable unit controlling a speed increase of one of said motors when said difference exceeds a preset limit value, the programmable unit acting selectively on only one of said motors as a function of a sign, positive or negative, of said difference.

4. A device according to claim 1, wherein said grinding wheels are mounted on respective motorized slides so as to adjust the pressure that each of said grinding wheels exerts on the corresponding side of the cutting edge, said programmable unit controlling, during sharpening, movement of a grinding wheel towards a respective side of the cutting edge when said difference exceeds a preset limit value, said programmable unit acting selectively on only one of the slides as a function of a sign, positive or negative, of said difference.

5. A device according to claim 1, wherein said sensor is an inductive sensor.

6. A device according to claim 1, wherein said sensor is a capacitive sensor.

7. A device for sharpening blades of cutting-off machines, comprising two grinding wheels, each of the two grinding wheels being positioned, during sharpening, on a corresponding side of two sides of a cutting edge of a blade of a cutting machine, the device comprising:

a means for controlling a symmetry of said cutting edge, said means comprising a sensor placed edge, during sharpening, at a predetermined distance from a corresponding side of the cutting, said sensor being adapted to detect possible differences between radial direction lengths of the two sides of the cutting edge, said sensor being connected to a programmable unit that processes a possible difference detected by the sensor, wherein said grinding wheels are dragged by respective motors, said programmable unit controlling a speed increase of one of said motors when said difference exceeds a preset limit value, the programmable unit acting selectively on only one of said motors as a function of a sign, positive or negative, of said difference.

8. A device for sharpening blades of cutting-off machines, comprising two grinding wheels, each of the two grinding wheels being positioned, during sharpening, on a corresponding side of two sides of a cutting edge of a blade of a cutting machine, the device comprising:

a means for controlling a symmetry of said cutting edge, said means comprising a sensor placed, during sharpening, at a predetermined distance from a corresponding side of the cutting edge, said sensor being adapted to detect possible differences between radial direction lengths of the two sides of the cutting edge, said sensor being connected to a programmable unit that processes a possible difference detected by the sensor, wherein said grinding wheels are mounted on respective motorized slides so as to adjust the pressure that each of said grinding wheels exerts on the corresponding side of the cutting edge, said programmable unit controlling, during sharpening, movement of a grinding wheel towards a respective side of the cutting edge when said difference exceeds a preset limit value, said programmable unit acting selectively on only one of the slides as a function of a sign, positive or negative, of said difference.

* * * * *